US006595498B1

(12) United States Patent
Andersen

(10) Patent No.: US 6,595,498 B1
(45) Date of Patent: Jul. 22, 2003

(54) FENCING DEVICE, PARTICULARLY INTENDED FOR SMALL CHILDREN

(75) Inventor: Finn Andersen, Ry (DK)

(73) Assignee: Baby Dan A/S, Laasby (DK)

( * ) Notice: Subject to any disclaimer, the term of this patent is extended or adjusted under 35 U.S.C. 154(b) by 0 days.

(21) Appl. No.: 09/763,211

(22) PCT Filed: Aug. 20, 1999

(86) PCT No.: PCT/DK99/00445

§ 371 (c)(1),
(2), (4) Date: Feb. 20, 2001

(87) PCT Pub. No.: WO00/11301

PCT Pub. Date: Mar. 2, 2000

(30) Foreign Application Priority Data

Aug. 20, 1998 (DK) ..... 1998 01051

(51) Int. Cl.[7] ..... E04H 17/14; E04H 17/16

(52) U.S. Cl. ..... 256/67; 256/24; 256/26; 403/24; 403/116

(58) Field of Search ..... 403/24, 97, 98, 403/101, 103, 104, 107, 116, 119, 380, 325, 329, 347, 378; 256/24, 25, 26, 27, 28, 60, 73, 67; 16/82, 54, 280, 285, 312, 357, 322, 332

(56) References Cited

U.S. PATENT DOCUMENTS

| | | | | |
|---|---|---|---|---|
| 615,690 A | | 12/1898 | Eschweiler | |
| 959,560 A | | 5/1910 | Landis | |
| 2,011,528 A | * | 8/1935 | Seay | 256/26 |
| 3,118,167 A | | 1/1964 | Morris et al. | |
| 3,841,042 A | | 10/1974 | Siegal | |
| 4,880,331 A | * | 11/1989 | Zun | 403/24 |
| 5,062,181 A | | 11/1991 | Bobowski et al. | |
| 5,240,265 A | * | 8/1993 | Huang | 403/116 |

* cited by examiner

*Primary Examiner*—Gregory J. Binda
*Assistant Examiner*—Victor MacArthur
(74) *Attorney, Agent, or Firm*—Dykema Gossett PLLC

(57) ABSTRACT

A safety barrier device, particularly intended for small children, and comprising at least two fence-like sections which may be interconnected and positioned at an angle, characterized in that the sections are interconnected by hinge links comprising two cooperating toothed rims arranged so that they may be lifted out of engagement, thereby allowing the sections to be freely positioned at an angle. The structure makes it possible to produce fireguards, pens or beds.

7 Claims, 1 Drawing Sheet

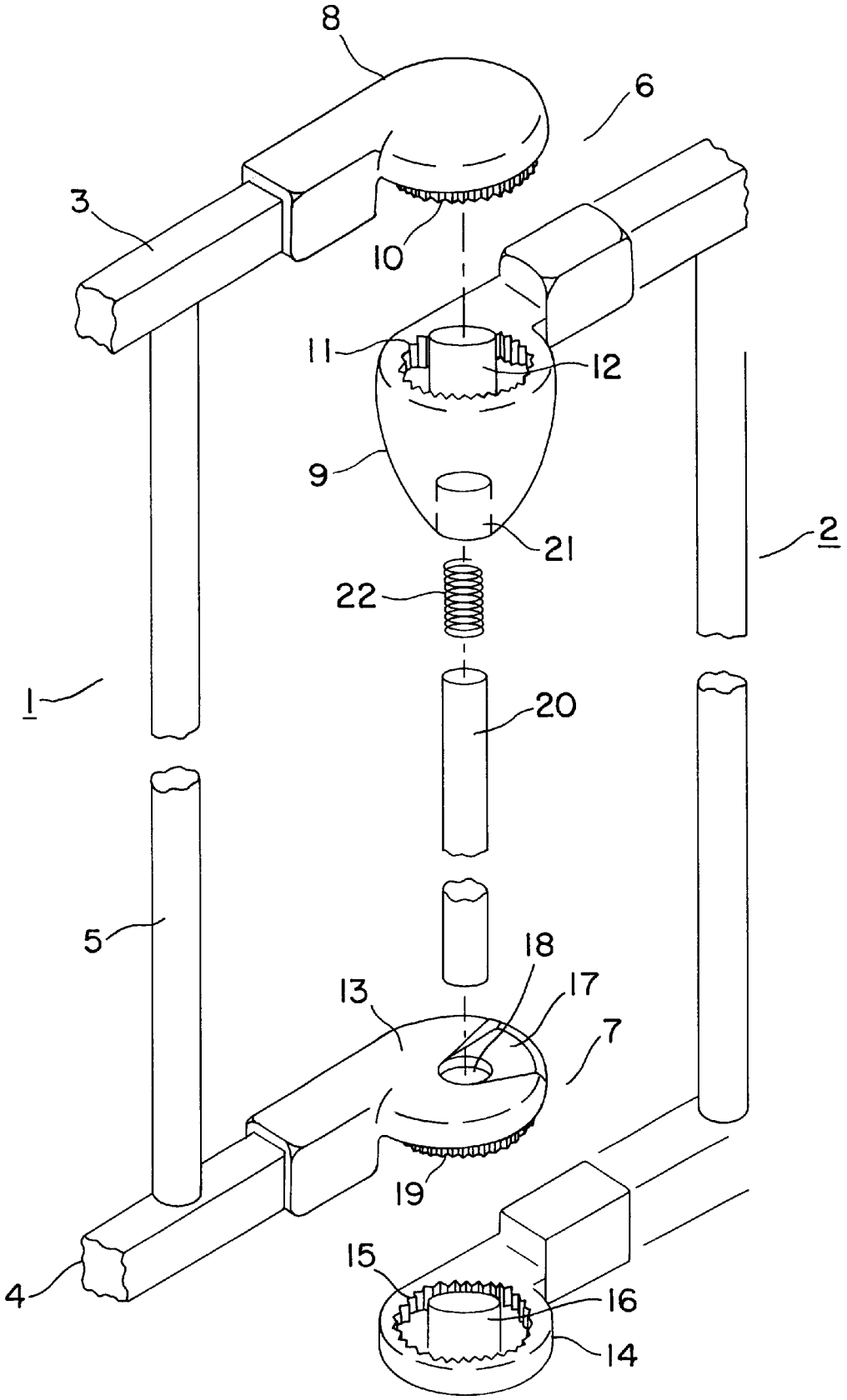
8
6
3
10
11
12
9
21
2
22
1
20
5
18
17
13
7
19
4
15
16
14

FENCING DEVICE, PARTICULARLY INTENDED FOR SMALL CHILDREN

BACKGROUND OF THE INVENTION

1. Field of the Invention

The present invention relates to a safety barrier device, particularly intended for small children, and comprising at least two fence-like sections which may be interconnected and be positioned at an angle, where the sections are interconnected by hinge links, each comprising two parts with cooperating toothed rims arranged so that they may be lifted out of engagement, thereby allowing the sections to be freely positioned at an angle.

2. The Prior Art

Different forms of safety barrier devices for small children are available, said devices being configured to satisfy specific purposes. An example is a fireguard which is placed in front of stoves or fireplaces, open or closed, to keep the children at a safe distance from these so that they do not get burned. Another example is child safety barriers intended to be positioned in door openings or at staircases so that the children can move freely in a confined room or section of the housing without getting hurt. As regards babies, they may be put in a pen.

From U.S. Pat. No. 95,960 a hinge construction designed for shutters is known. The hinge is provided with a number of notches on one hingepart and a latch on the other hingepart for locking the shutter in a fixed position. The weight of the shutter holds it in the wanted position.

SUMMARY OF THE INVENTION

The invention provides a new form of safety barrier device which is characterized in that one part of each hinge link can comprise a projecting portion provided with a toothing on the periphery, and that the other part of the hinge link can have a depression whose side wall is provided with a toothing for receiving the projecting portion on the first part of the hinge link where the hinge links are provided with a control pin about which the parts of the hinge links can rotate.

This opens up the possibility of configuring a safety barrier device so that it is useful as a fireguard, a pen, a bunk bed, etc.

A prefered embodiment of the invention can comprise two hinge links interconnected with a connecting pin where the lower part of the upper hinge link can have a hole for receiving the end of the connecting pin. The hole in the upper hinge link is a blind hole with a spring for affecting the connecting pin with a spring force down in the lower hinge link. It is noted that, after assembly, the connecting pin forms a lattice bar in the barrier, positioned with a spacing as specified by safety regulations.

The upper part of the lower hinge link can have a cut-out, preferably an angular cut-out. This cut-out is for catching and inserting the end of the connecting pin.

A prefered shape of the bottom of the cut-out is inclined upwardly from the periphery and until the connecting position of the connecting pin. This shape makes it more easy to insert the connecting pin.

In a prefered embodiment of the invention the sections can be constructed as a lattice structure with upper and lower cross members between which lattice bars are arranged, and the hinge links can be configured for mounting on the end of the upper and lower cross members, preferably in that these can have a hole for receiving the ends of the cross members which then can be secured as a press fit in the holes. This way a simple mounting of the hinges on the cross members is achieved.

In a prefered embodiment of the invention the hinge links are constructed so that the part with the toothing is disposed on one side of the sections, while the hinge links with the other side are flush with the sections.

An embodiment of the invention will be described more fully below with reference to the accompanying figure.

BRIEF DESCRIPTION OF THE FIGURE

The FIGURE shows an exploded view of the joint between two sections.

DETAILED SUMMARY OF THE PREFERRED EMBODIMENT

The sections 1, 2 are here lattice structures comprising upper and lower cross members 3, 4 of pipes having a square cross-section. The upper and lower cross members have interposed between them lattice bars 5 of a circular cross-section positioned with a spacing as specified by safety regulations. The sections are interconnected at the top and at the bottom by a hinge 6, 7.

The upper hinge 6 comprises two parts 8, 9 which, with a hollow, are pressed inwardly over the ends of the upper cross member and the lower cross member, respectively. The one hinge part 8 on a projecting portion is formed with a toothed rim 10, and the other hinge part 9 is formed with a corresponding toothed rim 11 in a well in which the first toothed rim 10 may be received. The well accommodates a shaft 12 which fits into a mating hole in the other hinge part 8.

The lower hinge 7 also comprises two parts 13, 14, of which the part 14 is likewise formed with a well having a toothed rim 15 and a tubular upwardly extending pin 16. The other hinge part 13, like the upper hinge, comprises a part having a toothed rim 19 which fits into the well on the other hinge part. The upper side of the hinge part 13 is formed with an angular recess 17 whose bottom is inclined from the periphery upwardly toward the centre, which is formed with a hole 18.

The two sections are assembled in that the respective hinge parts are telescoped into each other. A connecting pin 20 is passed into a hole 21 in the bottom of the upper hinge part 9. A spring 22 pressing the pin downwards is provided at the bottom of the hole. The connecting pin is moved with its lower end in the angular recess 17 in the hinge part 13 until the end slides down into the hole and further down into the tubular pin 16 in the hinge part 14. It will be seen that the two sections may be positioned at an angle by lifting the section 1 until the toothed rims on the hinge parts are disengaged, whereby the sections can rotate freely with respect to each other. When the section 1 is lowered, the toothed rims are again mutually engaged and the sections are locked in the desired position.

It is noted that the "heads" with the toothed rims on the hinge parts are angularly offset relatively to the "stem parts" by which they are secured to the sections. The offset is arranged so that the hinges are seated on one side of the sections, while the other side has a one-plane appearance.

At the end of the section 1 which is not shown, there is a set of hinge parts, as shown on the other section 2, while, on the other hand, it has a set of hinge parts at its other end as shown on section 1.

The structure also allows a door to be arranged in a section in a manner similar to a child safety barrier.

The stated structure makes it possible to produce a fireguard, a pen or a bed. The pen and the bed will of course consist of four uniform sections, alternatively two pairs of sections, where a pair of long sections forms sides, while two short sections form ends. The lattice bars and the lower cross members create a natural basis for the mounting of a bottom in the structure, e.g. with fittings which are fixed around the lattice bars. The fireguard may be composed of an arbitrary number of sections. It should be stated in this connection that the structure may of course be used for blocking any area and not just a stove or fireplace, open or closed.

Sections in the form of a lattice structure have been described in the foregoing, but, of course, other forms of sections may be used, e.g. plate- or net-shaped ones.

The hinge links described in the foregoing are provided with a toothing on a wall face, but, of course, nothing prevents the toothing from being arranged on end faces, e.g. on the underside of the elevation on the one hinge part and at the bottom of the well on the other hinge part, respectively. Of course, it may also be a combination of the two toothings. The fineness of the toothing is determined on the basis of strength and production considerations and the fineness desired in the angular positions of the sections.

What is claimed is:

1. A safety barrier assembly which comprises first and second fence sections which are interconnected and pivotable relative to each other by upper and lower hinge links, each of said upper and lower hinge links including a first hinge portion attached to said first fence section and a second hinge portion attached to said second fence section, one of said first and second hinge portions including a depression whose side wall includes teeth and the other of said first and second hinge portions including a projection having teeth in a periphery thereof, said projection fitting into said depression so that the teeth thereof are engagable, a control pin about which the hinge portions can rotate, a connecting pin which extends between said upper and lower hinge links, and a spring between said connecting pin and said upper hinge link to bias said connecting pin toward said lower hinge link.

2. A safety barrier assembly according to claim 1 wherein the upper hinge link includes a blind bore, and wherein an upper end of said connecting pin extends into said blind bore.

3. A safety barrier assembly according to claim 2, wherein said spring is located in said blind bore.

4. A safety barrier assembly according to claim 1, wherein an upper part of the lower hinge link includes a cut-out in which a lower end of the connecting pin extends.

5. A safety barrier assembly according to claim 4, wherein a bottom of said cut-out is inclined upwardly from a periphery to a connecting position of the connecting pin.

6. A safety barrier assembly according to claim 1, wherein the first and second fence sections include upper and lower cross members and vertical lattice bars therebetween and wherein said upper and lower hinge links are respectively connected to upper and lower cross members of said first and second fence sections.

7. A safety barrier assembly according to claim 1 wherein the first and second hinge portions of each of the upper and lower hinge links are offset from planes defined by said first and second fence sections.

* * * * *